US011590993B2

(12) United States Patent
Hammer et al.

(10) Patent No.: US 11,590,993 B2
(45) Date of Patent: Feb. 28, 2023

(54) DISPLAY OF SIGNAL DEVICES AND SAFETY DEVICE OF A RAILWAY VEHICLE

(71) Applicant: SIEMENS MOBILITY GMBH, Munich (DE)

(72) Inventors: Walter Hammer, Mannheim (DE); Matthias Alexander Weber, Uttenreuth (DE)

(73) Assignee: Siemens Mobility GmbH, Munich (DE)

( * ) Notice: Subject to any disclaimer, the term of this patent is extended or adjusted under 35 U.S.C. 154(b) by 554 days.

(21) Appl. No.: 16/493,869

(22) PCT Filed: Dec. 29, 2017

(86) PCT No.: PCT/EP2017/084792
§ 371 (c)(1),
(2) Date: Sep. 13, 2019

(87) PCT Pub. No.: WO2018/166647
PCT Pub. Date: Sep. 20, 2018

(65) Prior Publication Data

US 2021/0284208 A1 Sep. 16, 2021

(30) Foreign Application Priority Data

Mar. 13, 2017 (DE) ..... 10 2017 204 090.4

(51) Int. Cl.
*B61L 15/00* (2006.01)
*B61L 25/02* (2006.01)

(52) U.S. Cl.
CPC ..... *B61L 15/009* (2013.01); *B61L 25/025* (2013.01)

(58) Field of Classification Search
CPC ..... B61L 15/009; B61L 25/025; B61L 11/08; B61L 25/02
See application file for complete search history.

(56) References Cited

U.S. PATENT DOCUMENTS 6,824,110 B2 11/2004 Kane et al.
2007/0091625 A1* 4/2007 Kim ..... B60R 1/12 362/494

(Continued)

FOREIGN PATENT DOCUMENTS

CN 101357642 A 2/2009
CN 103171597 A 6/2013

(Continued)

OTHER PUBLICATIONS

Hofestaedt H et al., "Simis FFB-Funkfahrbetrieb Von Siemens Fuer Die Deutsche Bahn", [SMIS FFB from Siemens for the German Railways], Signal + D, DVV, (Jan. 1, 1999), vol. 91, No. 4, pp. 18-22, XP009067248, ISSN 0037-4997—English Summary on p. 22.

*Primary Examiner* — Tyler J Lee
*Assistant Examiner* — Yufeng Zhang
(74) *Attorney, Agent, or Firm* — Laurence A. Greenberg; Werner H. Stemer; Ralph E. Locher

(57) ABSTRACT

A method for displaying secondary signal devices for a driver of a railway vehicle during a journey by a railway vehicle. From a current vehicle position of the railway vehicle and an already known signal position of a secondary signal device, an actual distance of the railway vehicle in relation to the secondary signal device is determined. In the case that the actual distance is not reached in respect of a predefined current warning distance of the railway vehicle relative to the secondary signal device, a proximity of the railway vehicle relative to the secondary signal device is displayed to the driver.

13 Claims, 1 Drawing Sheet

(56) References Cited

U.S. PATENT DOCUMENTS

| | | | | |
|---|---|---|---|---|
| 2008/0243349 | A1 | 10/2008 | Trautenberg | |
| 2017/0050654 | A1 | 2/2017 | Perras et al. | |
| 2018/0012091 | A1* | 1/2018 | Ricci | G06Q 20/14 |

FOREIGN PATENT DOCUMENTS

| | | | |
|---|---|---|---|
| CN | 104691581 | A | 6/2015 |
| DE | 19927023 | A1 | 12/2000 |
| DE | 102012102892 | A1 | 10/2013 |
| DE | 102014211840 | A1 | 12/2015 |
| EP | 0893322 | A1 | 1/1999 |
| EP | 1975029 | A1 | 10/2008 |
| WO | 2006136783 | A1 | 12/2006 |

* cited by examiner

DISPLAY OF SIGNAL DEVICES AND SAFETY DEVICE OF A RAILWAY VEHICLE

BACKGROUND OF THE INVENTION

Field of the Invention

The invention relates to a method for displaying secondary signal devices for a driver of a railway vehicle during a journey by the railway vehicle. The invention also relates to a computer program or a computer program product comprising program code means, which are designed to carry out a method according to the invention. The invention furthermore relates to a computation unit or a processing device, in particular a control apparatus or a control device, for a railway vehicle, and to a safety device for a railway vehicle.

WO 2006/136 783 A1 discloses a safety device for a train in transit in a rail network. A GPS receiver is installed on a front end and a second GPS receiver, which is able to be identified separately, is installed on a rear end of the train. The GPS receivers are used to ascertain an identity, a continuous time position, a direction and a speed of the train within a rail network. A signal display in the train can display a signal when the train is located within a predetermined distance from a detectable object along a traveled track.

DE 199 27 023 A1 discloses a method for prescribing call times during the radio-controlled railway operation for trains. In the case of physically closely adjacent route elements, provision is made for corresponding switch-on commands and switchover commands to be emitted in an order in which the route elements are arranged on a track. For temporally bringing forward call times of the route elements, offsets are prescribed manually offline according to the method in such a way that, after they have been set, journeys of the train over a relevant section of track are simulated, wherein a check is carried out to determine whether a timely switch-on of the individual route elements is able to be achieved in the prescribed order or not using the respectively present communication terminals.

For a driver of a railway vehicle (traction vehicle, locomotive, end car, drive car, self-driving special vehicle for railway operations etc.), external signal apparatuses or signal devices on the track traversed by the railway vehicle are sometimes only able to be identified with difficulty in the case of adverse weather conditions (fog, heavy rain, heavy snow, backlighting, dusk etc.) with respect to the railway vehicle. There is the danger that said signal apparatuses or signal devices are identified too late or the signal thereof is missed. Since primary, prioritized or safety-relevant signals from signal devices or signal apparatuses (also) reach the driver in the driver's cabin, although missing a secondary signal device on the track does not result in hazards, delays and interruptions in the railway network can arise as a result.

SUMMARY OF THE INVENTION

It is an object of the invention to specify a method by way of which delays and interruptions in the railway network can be minimized or prevented. It is also an object of the invention to specify a corresponding computer program or computer program product, a corresponding computation unit or processing device, in particular a control apparatus or a control device, for a railway vehicle, and also a corresponding safety device for a railway vehicle. In the following text, the term "secondary signal device" is to be understood as meaning a non-primary, a non-prioritized, a nonsafety-relevant or a safety-irrelevant signal apparatus or signal device (see also below).

The object of the invention is achieved by way of a method for displaying secondary signal devices for a driver of a railway vehicle during a journey by the railway vehicle; by means of a computer program or computer program product; by means of a computation unit or a processing device, in particular a control apparatus or a control device, for a railway vehicle; and by means of a safety device for a railway vehicle; according to the independent claims. Advantageous developments, additional features and/or advantages of the invention result from the dependent patent claims and/or the following description of the invention.

In the method according to the invention for displaying, in particular, only secondary signal devices, an actual distance of the railway vehicle with respect to the secondary signal device is ascertained from a current vehicle position of the railway vehicle and an already known signal position of a secondary signal device, wherein, if the actual distance is not reached with respect to a predetermined actual warning distance of the railway vehicle with respect to the secondary signal device, a proximity of the railway vehicle with respect to the secondary signal device is displayed to the driver, wherein the secondary signal device ought to be observed by the driver, whereas a primary, that is to say safety-relevant and prioritized, signal device must be observed by the driver. The actual distance or the actual warning distance may be a temporal and/or physical distance. The same applies to the (temporal and/or physical) proximity of the railway vehicle with respect to the secondary signal device.

The primary, that is to say safety-relevant and prioritized, signal device must be observed by the driver of the railway vehicle, otherwise there is a danger for people and the environment, except for precautions by way of other safety mechanisms (traffic controllers, automation etc.). A primary signal device may be, for example (country-specific): an advance signal device (DE), a main signal device (DE), a disabling signal device (DE), a speed restriction signal, an intersection light, etc. The secondary signal device ought to be observed by the driver.

A secondary signal device may be, for example, a signal device for (country-specific): an overhead line signal (DE), a warning signal device for a railroad crossing monitoring signal device (DE), a platform (DE) etc.

According to the invention, a/the temporal and/or physical actual distance of the railway vehicle from a/the secondary signal device is ascertained from at least one piece of information about a/the current vehicle position of the (relevant) railway vehicle and from at least one piece of information about a/the already known signal position of a/the (relevant) secondary signal device. According to the invention, at least one piece of information about a/the temporal and/or physical proximity of the railway vehicle with respect to the (relevant) secondary signal device is also output to the driver based on a piece of information about a/the determined temporal and/or physical actual warning distance of the railway vehicle from a/the (relevant) secondary signal device. The ascertainment of a/the actual distance and/or a/the actual warning distance of the railway vehicle with respect to the secondary signal device is preferably carried out in this case by way of calculation.

A predetermined temporal actual warning distance may be a predetermined period required by the railway vehicle for a length of track still to be covered up to the secondary signal device. Furthermore, a predetermined physical actual warning distance may be a predetermined length of track still to be covered by the railway vehicle up to the secondary signal device and/or a predetermined straight-line distance still to be bridged by the railway vehicle up to the secondary signal device. In this case, a predetermined temporal actual warning distance may be multilevel.

By way of example, a predetermined temporal actual warning distance may be a period of at least 45 s, at least 30 s, at least 20 s, at least 15 s, at least 10 s, at least 7.5 s or at least 5 s, wherein a temporal repetition rate of a display of the secondary signal device to the driver preferably becomes smaller the closer the railway vehicle is located with respect to the secondary signal device. This is also able to be converted to a physical equivalent, wherein, where necessary, other lengths of track are able to be calculated according to a determined secondary signal device.

A currently traveled speed and/or average speed of the railway vehicle, a speed and/or average speed of the railway vehicle traveled in a determined recent period and/or a speed and/or average speed of the railway vehicle likely traveled in a determined future period can be used for determining the actual distance of the railway vehicle with respect to the secondary signal device.

The current vehicle position of the railway vehicle is preferably ascertained by way of a location method. Such a location method may be realized by way of a satellite-supported location method, a location method within a continuous train control system (LZB) or (later) a European train control system (ETCS), a GIS (geographic information system) location method, a camera location method based on an electronic map and a method for identifying a waypoint, etc.

The already known signal position of the secondary signal device can be ascertained based on a catalog containing track data, wherein the signal position is taken from the track data. Such a catalog containing track data may be, for example, a catalog containing track data for energy-saving travel. In one embodiment, the temporal and/or physical distance of the railway vehicle with respect to the secondary signal device can be ascertained in a safety device of the railway vehicle.

In one embodiment, by way of the display method during a journey of the railway vehicle, substantially all or only a selection of secondary signal devices can be displayed. Furthermore, the selection of secondary signal devices can be made depending on a type and/or a location of the secondary signal devices. In this case, a location may be specific and/or classified (for example clear tracks, stations etc.). Furthermore, in one embodiment, a display behavior of the display method can be designed to be able to be configured individually.

In one embodiment, the display of the proximity of the railway vehicle to the secondary signal device for the driver may be an optical display, an acoustic display and/or a haptic display. The optical display may be, for example, a (where necessary specified) display on a monitor, the illumination of a warning light etc. The acoustic display may be, for example, the sounding of a warning tone etc. The haptic display may be, for example, a movement output to a hand wheel, a lever, a switching element etc. Furthermore, an already present display device or a display device specific for said display can be used for displaying the proximity of the railway vehicle with respect to the secondary signal device.

According to the invention, the display method can be configured in such a way that only secondary signal devices can be displayed. Furthermore, the display method can be configured in such a way that additionally primary signal devices can also be displayed. The safety device of the railway vehicle is preferably designed as an electrical and/or electronic safety device. Furthermore, the safety device may comprise a computer program according to the invention. Moreover, the safety device may have a computation unit or processing device according to the invention.

The invention is able to be implemented as a computer program, for example in a computation unit according to the invention or a processing device according to the invention. That is to say that a computer program product according to the invention, for example a computer program on a data storage medium, comprises a program code, which comprises program code means for carrying out or executing the method according to the invention. In this case, the computer program can be executed on a (micro)processor or a (extremely small or small) computer and/or can be stored on a data storage medium or a digital memory medium.

Such a machine-readable or computer-readable data storage medium or such a digital memory medium may be, for example, a hard disk, a ROM, EPROM, EEPROM or a flash memory, a memory chip, a floppy disk, a CD-ROM, a DVD or a Blu-ray disk. The computer program may also be stored in the form of firmware. In this case, the computer program can interact with electronically available or readable (possibly open-loop/closed-loop) signals, for example information of a sensor, of an evaluation unit and/or of an actuator, in a programmable processor device or computer device or a corresponding system in such a way that an embodiment of the method according to the invention can be carried out or executed.

The computation unit according to the invention may be formed, for example, as an arithmetic-logic unit or as a subunit of the processing device according to the invention. The processing device is designed, for example, as an electronic computation device or computation unit, for example as a microcontroller or a processor, as an (extremely small or small) computer, a control device, or a control apparatus, or as another device or an apparatus, which can of course also carry out or execute other tasks. The computation unit or the processing device may also have the computer program product according to the invention.

According to the invention, the method may be used or applied in a safety device, for example in an assistance system of the railway vehicle and/or an automatic travel function of the railway vehicle, in order to increase the safety. The invention is thus possibly able to be carried out partially by means of a running gear device of the railway vehicle, in particular a brake and/or damper open-loop/closed-loop control system, and/or possibly partially by means of a rail piece device, in particular an engine (for example an acceleration intervention) and/or gear open-loop/closed-loop control system, of the railway vehicle.

The invention is described in greater detail in the following text using exemplary embodiments with reference to the appended drawing, which is diagrammatic and not to scale. Sections, elements, components, units, diagrams and/or component parts having an identical, univocal or analogous configuration and/or function are labeled with the same designations in the description of the figures (see below), the list of designations, the patent claims and in the figures of the drawing. Furthermore, a possible alternative, which is non-exhaustive and/or is not described in the description (description of the invention (see above), description of the figures (see below)) and is not shown in the drawing, a static and/or kinematic reversal, a combination, etc. with respect to the exemplary embodiments of the invention and/or a component, a diagram, a unit, a structural element, an element or a section thereof, can be gathered from the list of designations.

In the case of the invention, a feature (section, element, structural element, unit, component, function, size, etc.) can be of positive (that is to say, present) or negative (that is to say, absent) configuration, a negative feature not being described explicitly as a feature unless it is noted in accordance with the invention that it is absent. A feature of this specification (description, list of designations, patent claims, drawing) can be used not only in a specified type and/or way, but rather also in another type and/or way (isolation, combination, replacement, addition, individual use, omission, etc.). It is possible, in particular, to replace, add or omit a feature in the patent claims and/or the description on the basis of a designation and a feature assigned to the latter, or vice versa, in the description, the list of designations, the patent claims and/or the drawing. Moreover, as a result, a feature can be interpreted and/or specified in greater detail in a patent claim.

The features of this specification can also be interpreted as optional features (in view of the prior art which is usually unknown); that is to say, each feature can be understood to be an optional, arbitrary or preferred, that is to say not mandatory feature. A separation of a feature, possibly including its periphery, from an exemplary embodiment is thus possible, it then being possible for said feature to be transferred to a generalized concept of the invention. The absence of a feature (negative feature) in an exemplary embodiment shows that the feature is optional in relation to the invention. Furthermore, in the case of an identity of the type of a feature, a generic term for the feature can also be understood (possibly further hierarchical breakdown into sub-genre, sector, etc.), as a result of which, for example with consideration of equivalent effect and/or equivalence, a generalization of one or said feature is possible. In the figures which are merely by way of example:

DESCRIPTION OF THE INVENTION

Figure 1:
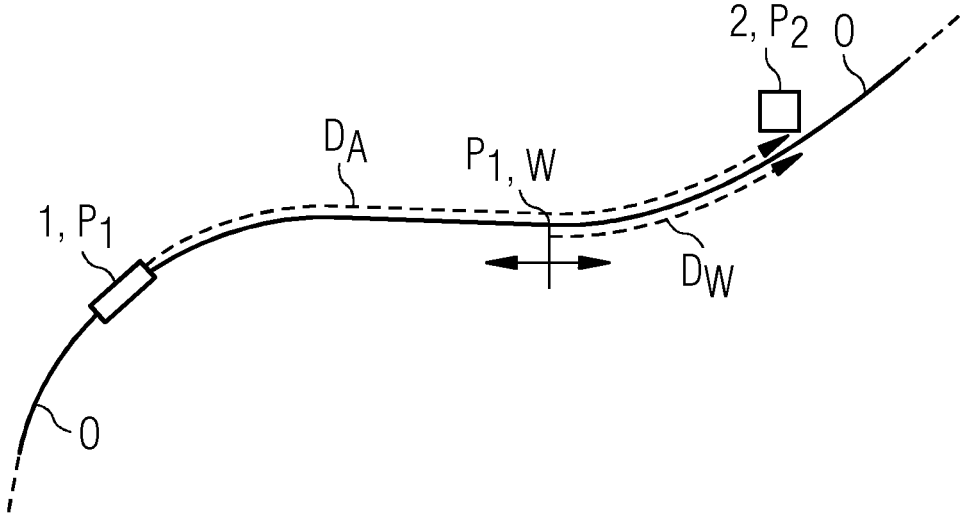
FIG. 1 shows a schematic plan view of a section of track of a railway network, wherein a railway vehicle is approaching a secondary signal device, and based on which a first embodiment of the method according to the invention is explained in more detail.

The invention is explained in more detail in the following text based on exemplary embodiments of two embodiments of a variant of methods according to the invention that are able to be carried out for displaying secondary signal devices 2 for a driver of a railway vehicle 1 during a journey by the railway vehicle 1. However, the invention is not restricted to such a variant, such embodiments and/or the exemplary embodiments explained below, but rather is of more fundamental nature, with the result that the invention can be applied to all display methods of secondary signal devices.

The drawing shows only those parts of a subject of the invention that are necessary for an understanding of the invention. Although the invention is described and illustrated in greater detail by way of preferred exemplary embodiments, the invention is not restricted by way of the disclosed exemplary embodiments. Other variations can be derived herefrom and/or from the above (description of the invention) without departing from the scope of protection of the invention.

Figure 2:
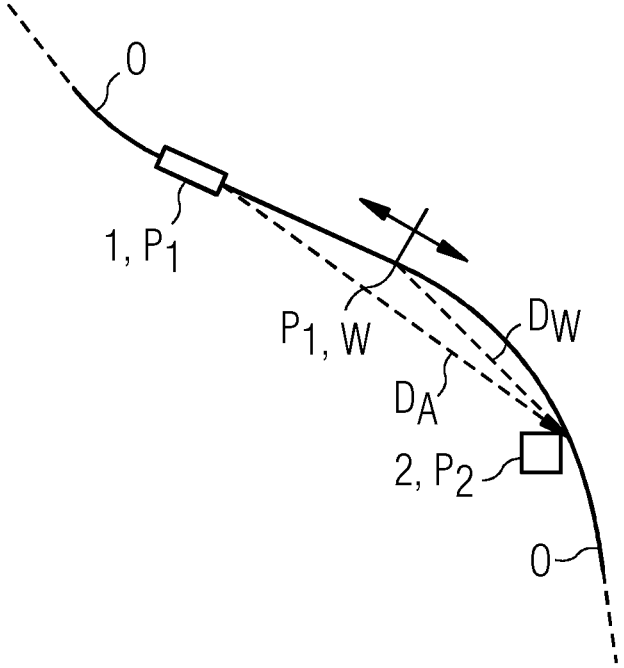
FIG. 2 likewise shows a schematic plan view of a section of track of the railway system, wherein again a railway vehicle is approaching a secondary signal device, and based on which a second embodiment of the method according to the invention is explained in more detail.

FIGS. 1 and 2 each show a plan view of a longitudinal section of a track 0 of a railway network, on which a respective railway vehicle 1 is approaching a secondary signal device 2. At the first respectively observed time, the railway vehicle 1 has a current but temporally variable vehicle position $P_1$ with respect to the track 0. An already known signal position $P_2$ of the secondary signal device 2 with respect to the track 0 is fixed. According to the invention, the temporal or physical approaching of the railway vehicle 1 with respect to the secondary signal devices 2 is intended to be displayed to a driver of the railway vehicle 1 during a journey. A period of time for the display of a relevant secondary signal device 2 of at least 5 s to at least 45 s before the railway vehicle 1 passes the relevant secondary signal device 2 is preferred here.

According to the invention, for a possibly (pre)selected secondary signal device 2, which the railway vehicle 1 is approaching, the current vehicle position $P_1$ of the railway vehicle 1 is ascertained by way of a location method. The already known signal position $P_2$ of the secondary signal device 2 can be ascertained, for example, based on a catalog containing track data. A temporal and/or physical actual distance $D_A$ of the railway vehicle 1 with respect to the secondary signal device 2 is ascertained from the current vehicle position $P_1$ and the already determined signal position $P_2$. This can be effected in principle in two ways. On the one hand, as illustrated by FIG. 1, a temporal and/or physical actual distance $D_A$, which is actually still to be traveled, from the railway vehicle 1 up to the relevant secondary signal device 2 can be determined. On the other hand, as illustrated by FIG. 2, a straight-line distance of the railway vehicle 1 up to the relevant secondary signal device 2 can be determined.

If the temporal and/or physical actual distance $D_A$ is not reached $D_A \leq / < D_W$ with respect to a predetermined temporal and/or physical actual warning distance $D_W$ of the railway vehicle 1 with respect to the secondary signal device 2, a temporal and/or physical proximity of the railway vehicle 1 with respect to the secondary signal device 2 is displayed to the driver. In this case, the temporal and/or physical actual warning distance $D_W$ is selected in such a way that the driver has substantially sufficient time (see periods of time above) to conclude a possibly already begun operation and subsequently to attend to a signal of the appearing secondary signal device 2 and to identify same.

The temporal and/or physical actual distance $D_A$ is preferably ascertained by means of a speed of the railway vehicle 1. In this case, a current speed and/or an average speed of the railway vehicle 1 can be used. In particular, it is possible here to use a speed and/or average speed of the railway vehicle 1 traveled in a determined recent period of time and/or a speed and/or average speed of the railway vehicle 1 likely traveled in a determined future period of time.

Railway vehicles often have track data available, for example for energy-saving travel, which essentially contain accurate locations of signal devices in a railway network. By comparing a vehicle position of a railway vehicle with track data, a distance of a relevant railway vehicle with respect to a relevant signal device is determined according to the invention. If the railway vehicle is approaching a signal device, this is displayed to a relevant driver of the railway vehicle in an appropriate manner (acoustically, optically and/or haptically).

The signal device is preferably a secondary signal device 2. It is of course possible to use this in addition to or as an alternative to a primary signal device. According to the invention, it is possible to allow all signal devices to be displayed or only certain ones, for example restricted to type and/or location, wherein locations may be specific or classified (for example clear tracks, stations etc.). In this case, it is possible to use an already present display device or a display device specific to this function. Furthermore, it is possible to enable a client to implement a display behavior (which signal devices, type, location etc.), a display device etc. themselves.

The invention claimed is:

1. A method of displaying secondary signal devices for a driver of a railway vehicle during a journey of the railway vehicle, the method comprising:

ascertaining a current vehicle position of the railway vehicle and determining an actual distance of the railway vehicle relative to a secondary signal device from the current vehicle position and a known signal position of the secondary signal device, and using a speed and/or average speed of the railway vehicle likely traveled in a determined future period of time for determining the actual distance of the railway vehicle from the secondary signal device; and if the actual distance undershoots a predetermined actual warning distance of the railway vehicle from the secondary signal device, displaying to a driver of the railway vehicle a proximity of the railway vehicle relative to the secondary signal device, wherein the actual warning distance is a predetermined temporal actual warning distance representing a predetermined period required by the railway vehicle for a length of track still to be traveled to the secondary signal device;

wherein the secondary signal device ought to be observed by the driver, whereas a primary, safety-relevant and prioritized signal device must be observed by the driver; and during a journey of the railway vehicle, selecting the secondary signal devices according to a type and/or a location of the secondary signal devices.

2. The display method according to claim 1, wherein:

the actual warning distance is also a predetermined physical actual warning distance representing a predetermined length of track still to be traveled by the railway vehicle up to the secondary signal device and/or a predetermined straight-line distance still to be bridged by the railway vehicle up to the secondary signal device.

3. The display method according to claim 1, wherein:

the predetermined temporal actual warning distance is a period selected from the group consisting of at least 45 s, at least 30 s, at least 20 s, at least 15 s, at least 10 s, at least 7.5 s, and at least 5 s, a temporal repetition rate of a display of the secondary signal device to the driver becomes smaller the closer the railway vehicle is located with respect to the secondary signal device.

4. The display method according to claim 1, which comprises also using at least one or more of the following for determining the actual distance of the railway vehicle from the secondary signal device:

a currently traveled speed and/or average speed of the railway vehicle; and/or a speed and/or average speed of the railway vehicle traveled in a determined recent period of time.

5. The display method according to claim 1, which comprises:

determining the current vehicle position of the railway vehicle by way of a location method; and/or ascertaining the already known signal position of the secondary signal device based on a catalog containing track data, and thereby taking the signal position from the track data.

6. The display method according to claim 1, which comprises, during a journey of the railway vehicle, performing at least one or all of the following:

displaying substantially all or only a selection of secondary signal devices; and/or enabling an individual configuration of a display behavior of the display method.

7. The display method according to claim 1, which comprises ascertaining a temporal and/or physical distance of the railway vehicle with respect to the secondary signal device in a safety device of the railway vehicle.

8. The display method according to claim 1, which comprises:

displaying the proximity of the railway vehicle to the secondary signal device for the driver by at least one of an optical display, an acoustic display, or a haptic display; and/or displaying the proximity of the railway vehicle with respect to the secondary signal device with an already present display device or a display device specific for the display method.

9. The display method according to claim 1, wherein:

the display method is configured to display only secondary signal devices;

the display method is configured to additionally display primary signal devices;

the display method is configured to additionally display a safety device, the safety device is an electrical and/or electronic safety device; and/or the safety device is a safety device configured to:

carry out the method according to claim 1.

10. A non-transitory computer program or computer program product comprising program code designed to carry out the method according to claim 1 when the program code is executed on a computation unit or a processing device.

11. The non-transitory computer program according to claim 10 stored on a computer-readable data storage medium.

12. A computation unit or a processing device being a control apparatus or a control device for a railway vehicle, wherein the computation unit or processing device is configured to:

carry out the method according to claim 1 under control of the computation unit or the processing device.

13. A safety device for a railway vehicle, configured to carry out the method according to claim 1.

* * * * *